US006742880B2

(12) United States Patent
Jones et al.

(10) Patent No.: US 6,742,880 B2
(45) Date of Patent: Jun. 1, 2004

(54) DUAL CHAMBER CARTRIDGE

(75) Inventors: Bruce S. Jones, Franklin, TN (US); Stephen A. Anderson, Thompson Station, TN (US); Patrick D. Carter, Fairview, TN (US); William A. Putman, Franklin, TN (US)

(73) Assignee: Nu-kote International, Inc., Dallas, TX (US)

( * ) Notice: Subject to any disclaimer, the term of this patent is extended or adjusted under 35 U.S.C. 154(b) by 0 days.

(21) Appl. No.: 10/149,106

(22) PCT Filed: Oct. 5, 2001

(86) PCT No.: PCT/US01/31245

§ 371 (c)(1),
(2), (4) Date: Jun. 6, 2002

(87) PCT Pub. No.: WO02/28644

PCT Pub. Date: Apr. 11, 2002

(65) Prior Publication Data

US 2003/0011667 A1 Jan. 16, 2003

Related U.S. Application Data

(60) Provisional application No. 60/239,079, filed on Oct. 6, 2000.

(51) Int. Cl.[7] ..... B41J 2/175

(52) U.S. Cl. ..... 347/86

(58) Field of Search ..... 347/85, 86, 87, 347/92, 93

(56) References Cited

U.S. PATENT DOCUMENTS

| | | | | |
|---|---|---|---|---|
| 5,875,615 A | * | 3/1999 | Ito et al. | 53/474 |
| 6,048,056 A | | 4/2000 | Hotomi | |
| 6,170,941 B1 | | 1/2001 | Hara et al. | |
| 6,325,499 B1 | * | 12/2001 | Betschon | 347/86 |

* cited by examiner

*Primary Examiner*—Anh T. N. Vo
(74) *Attorney, Agent, or Firm*—Fay, Sharpe, Fagan, Minnich & McKee, LLP

(57) ABSTRACT

An ink tank cartridge for an ink-jet type recording apparatus includes a housing with a plurality of walls forming a cavity and a bottom wall. A removable divider wall or spacer is inserted into the cavity which divides the cavity into first and second chambers. The spacer includes a wall section and a pair of legs extending from the wall which are spaced apart and are parallel to each other. The spacer is substantially U-shaped where the U-shape is formed by the legs and the wall section. A porous member is inserted into one of the chambers and resiliently abuts an opening of the supply port. The other chamber is at least partially filled with ink. The spacer has an opening to allow the ink to pass from the ink chamber to the foam chamber. The spacer is inserted into the chamber so that the opening is adjacent the bottom wall of the housing.

20 Claims, 3 Drawing Sheets

DUAL CHAMBER CARTRIDGE

CROSS-REFERENCE TO RELATED APPLICATIONS

This application claims priority from Provisional Application No. 60/239,079 filed on Oct. 6, 2000.

BACKGROUND OF THE INVENTION

This invention relates generally to the ink-jet printing art for ejecting ink droplets onto a recording medium, such as paper, and more particularly, to an ink tank cartridge for use in an ink-jet type recording apparatus such as a printer.

In a conventional recording apparatus, ink is supplied to a recording head from an ink tank constructed as a cartridge. A benefit of using an ink cartridge serving as an ink tank is that ink does not smear due to the leakage of ink while refilling new ink or the like. However, undesired air bubbles can easily enter the ink tank during the filling process which cause problems such as ink supply failure. Controlling the flow of ink from the cartridge is also a concern.

A cartridge can be divided into multiple chambers, where a porous foam is positioned over an outlet port in one chamber and free ink is filled into the other chamber. The free ink migrates from its chamber into the foam chamber. The foam in turn, controls the flow of ink that enters into an ink outlet port. Thus there is a need for converting a single chamber cartridge into a dual chamber cartridge so that either a foam member can occupy an entire single chamber of a cartridge or two chambers can be established wherein a foam member occupies one chamber and free ink occupies the other chamber.

Accordingly, it is desirable to develop a new and improved ink cartridge which would meet the above stated needs and others and provide better and more advantageous overall result.

SUMMARY OF THE INVENTION

Generally speaking, in accordance with the invention, an ink tank cartridge for an ink-jet type recording apparatus being removably mounted on an ink supply needle of a recording body is provided.

More particularly, the invention relates to an ink tank cartridge for an ink-jet type recording apparatus which is removably mounted onto an ink supply needle of the recording apparatus. The ink tank cartridge includes a housing comprising a plurality of walls forming a cavity and a bottom wall. An ink supply port extends through bottom wall. A removable divider wall or spacer is inserted into the cavity to form first and second chambers on opposite sides thereof.

A porous member is inserted into one of the chambers and abuts the supply port. The other chamber is at least partially filled with ink. The spacer has an opening to allow the ink to pass from the ink chamber to the foam chamber. The spacer is inserted into the chamber so that the opening is adjacent the bottom wall of the housing. The spacer is substantially U-shaped including a wall section and a parallel pair of legs extending therefrom.

A groove is formed in the bottom wall to direct and transfer ink from the porous member to the ink outlet port. A filter is positioned over the ink supply port and the groove. A cover is sealed to the top surface of the housing, preferably ultrasonic ally welded thereto, and includes a fill hole. A seal member is inserted into the supply port and is held in place by a retaining member.

Alternately, the spacer comprises a first section, a second section, and a third section where the first and second sections are hingedly connected to the third section. The spacer is inserted into the cavity where the wall sections abut opposing side walls of the housing to divide the cavity into first and second chambers.

A method for converting a single chamber ink-jet cartridge into a two chamber cartridge comprises the following steps. The spacer is bent to form a generally U-shaped conformation. The spacer is inserted into the housing cavity with the wall of the spacer toward a first end of the housing and with the legs of the spacer extending toward a second end of the housing in close proximity to the side walls of the housing. Thereby dividing the housing into first and second chambers. A notch or recess in the spacer is positioned to face the bottom wall of the housing and form a passage or opening from the first chamber to the second chamber.

A filter is inserted into the bottom surface of the housing above the ink outlet opening. Preferably, the filter is fused to the bottom wall. Then an ink absorbing member is inserted into one of the first and second chambers. A sealing member is inserted into the ink outlet port of the housing to prevent air from entering the cartridge. The seal member is held in place by attaching a retaining member around the outlet opening.

A cover is secured to a top portion of the housing, for example, by ultrasonic ally welding or fusing the cover to the housing. A negative pressure is applied to the cartridge to substantially remove air in a cartridge prior to filling the cartridge with ink. The cartridge is pressure filled with degassed ink through a fill hole in the cover. A negative pressure is then, again, applied to the cartridge to degas the ink, removing any air retained during the filling process. The fill hole is then sealed with a sealing member to prevent leakage and evaporation of the ink. The sealing member is a polypropylene coated foil attached to the top surface of the cover. The sealing member may be attached by a method such as thermal bonding or using adhesive.

Alternately, the cover may include a vent passage in addition to the fill hole. The vent passage is sealed by a valve adapted to permit selective flow of fluid through the vent passage. After the cartridge has been evacuated, pressure filled, and evacuated again through the fill port, the fill port is sealed and a negative pressure is applied to the cartridge by way of the valve in the vent passage to generate a negative pressure with the cartridge. The valve thereafter acts to maintain the negative pressure in the cartridge.

Sill other aspects of the invention will become apparent to those skilled in the art upon reading and understanding the following detailed description.

BRIEF DESCRIPTION OF THE DRAWINGS

The invention may take form in certain components and structures, preferred embodiments of which will be illustrated in the accompanying drawings wherein.

DETAILED DESCRIPTION OF THE EMBODIMENTS

Figure 1:
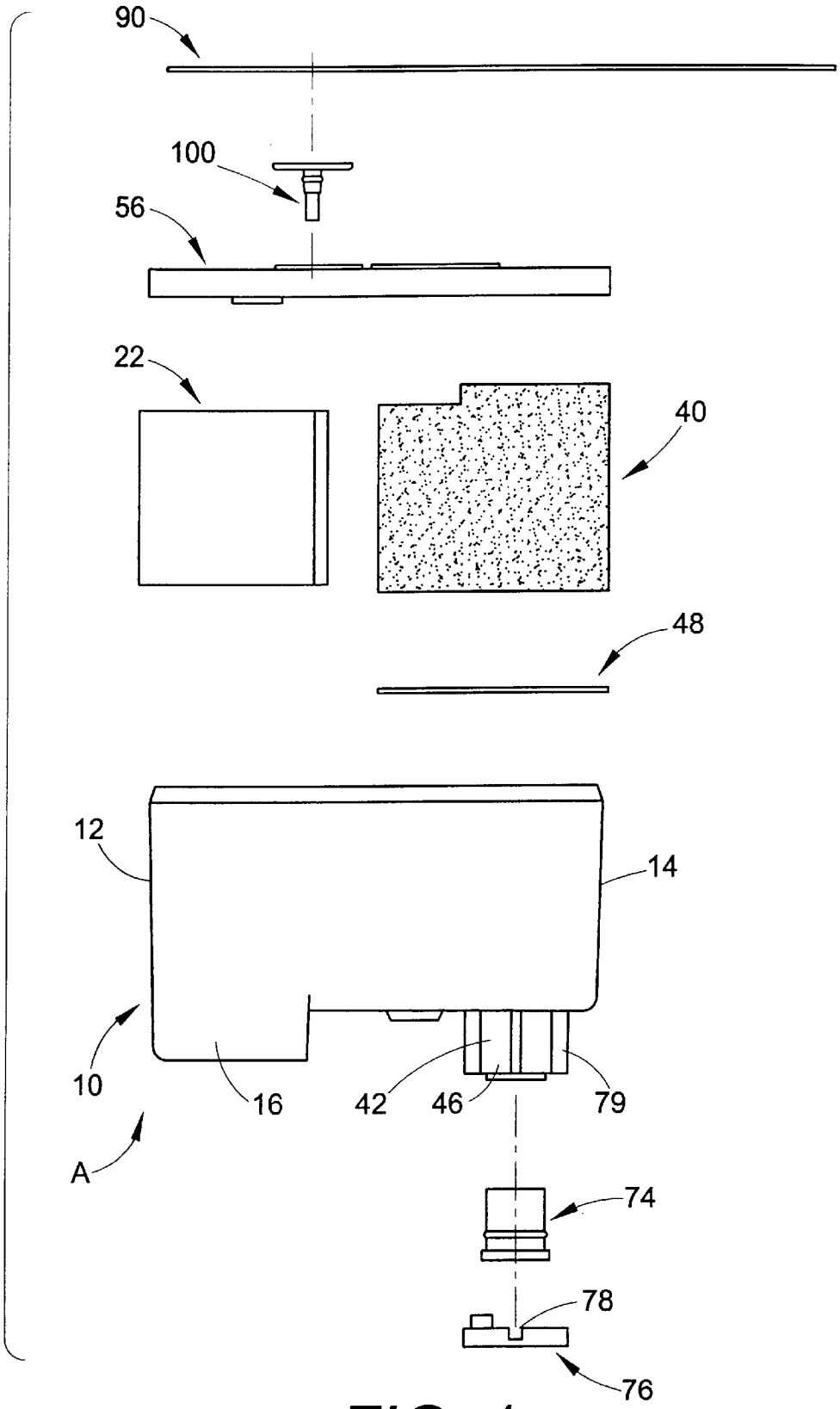
FIG. 1 is an exploded elevational view of an ink cartridge according to a first embodiment of the present invention.

Referring now to the drawings, wherein the showings are for purposes of illustrating preferred embodiments of the invention only and not for purposes of limiting same, FIG. 1 shows an ink cartridge A according to one embodiment of the present invention.

Figure 2:
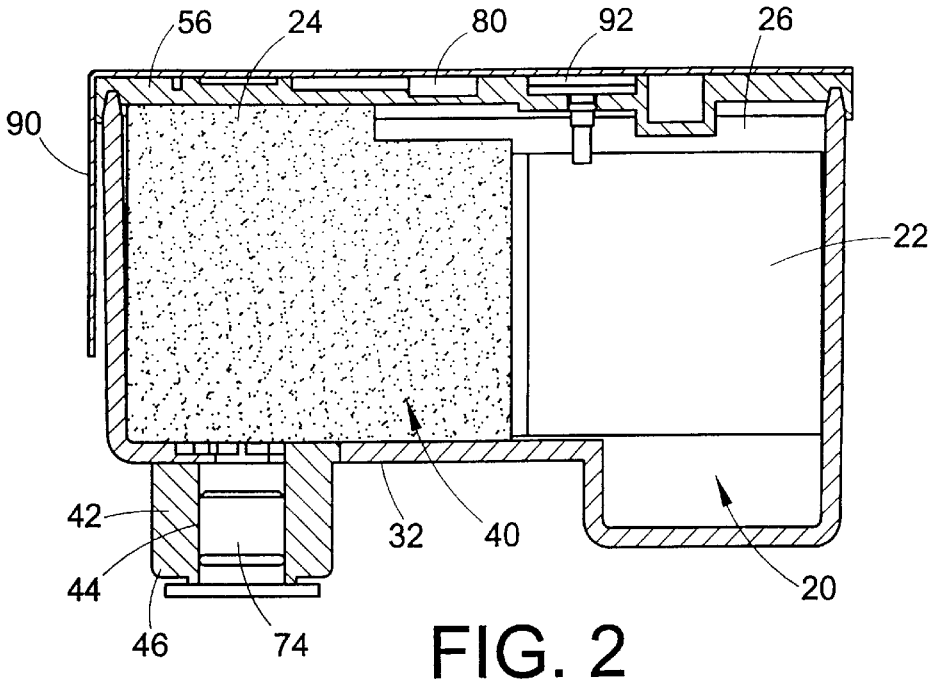
FIG. 2 is a side elevational view in cross-section of the ink cartridge of FIG. 1; and, FIG. 3 is a side perspective view of a spacer wall used with the ink cartridge of FIG. 1; and, FIG. 4 is a top plan view of a bottom wall of the ink tank cartridge of FIG. 1.
Figure 3:
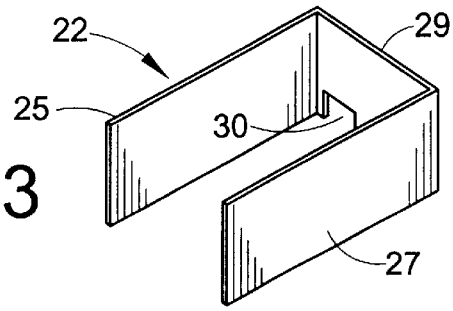
Figure 4:
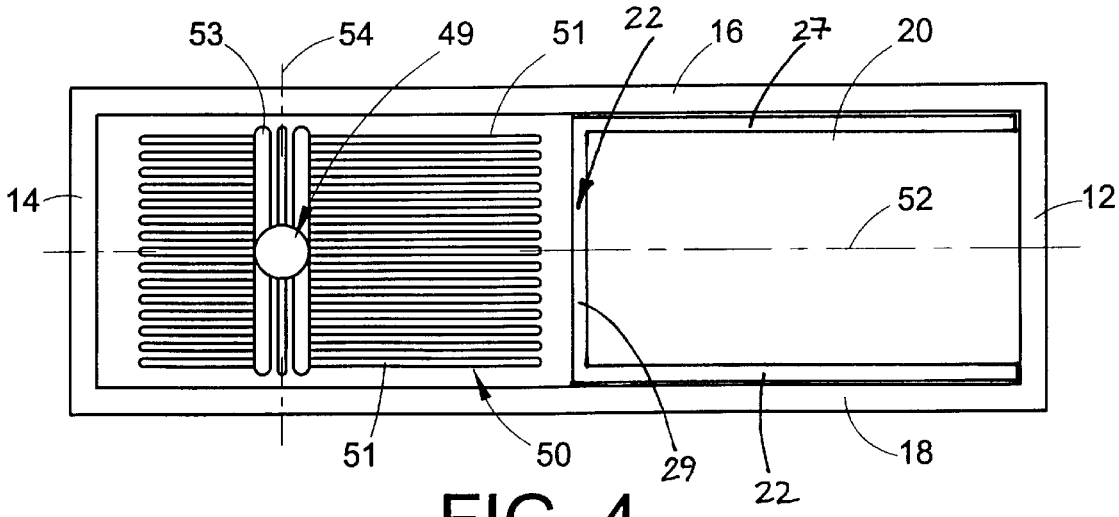

More specifically, the ink tank cartridge comprises a case or housing 10 which has an internal chamber of generally rectangular cross section. The housing is formed by a series of walls 12, 14, 16, 18, which form the rectangular cross section and an internal cavity 20 (see FIG. 2). An additional removable wall or spacer 22, which is preferably U-shaped as shown in FIG. 3, divides the housing internal cavity into two substantially equally sized smaller chambers 24,26. The spacer comprises two legs 25, 27 and a wall 29 which is connected between the two legs. The spacer is preferably formed of plastic although alternative materials that are suitable for the ink tank environment can be used without departing from the scope and intent of the present invention. The spacer is bent or folded at two score lines so that it takes on a generally U-shape conformation. It should be noted that the spacer could also form alternate configurations, such as a T-shape or S-shape as may be particularly desired for a specific end use.

The spacer is inserted into the housing with the wall 29 of the spacer spaced toward a first or forward end of the housing, and with the legs 25, 27 extending toward a second or rearward end in close proximity to opposed sidewalls 16, 18 of the housing. A notch or recess 30 (FIG. 3) in the bottom of wall 29 of the spacer is disposed to face toward a bottom wall 32 of the housing. This effectively divides the internal cavity into the first and second chambers which are in communication with each other through the notch for ink storage and transfer purposes.

Chamber 26 is used to store free ink while chamber 24 receives an ink absorbing member 40. The ink absorbing member is constructed with a cross-sectional area slightly greater than the cross-sectional area of the chamber. The ink absorbing member comprises a block of porous material which is formed of Melamine™ or hydrophilic foam and is disposed in chamber 24 adjacent an outlet port 42 located within the bottom wall 32 of the cartridge. The outlet port comprises an opening 44 and a pipe-like or chimney member 46 which extends from the bottom wall of the housing.

A filter or screen 48 is inserted over the chimney member 46 prior to inserting the ink absorbing member in the cartridge. Thus, the screen is interposed between the ink absorbing member and the outlet port to prevent egress of air bubbles, contaminants, and the like from the cartridge from entering the associated printer (not shown). The filter, which is mesh, has a preferred pore size of about 0.5–100 microns (which is less than the pore sizes in the ink absorbing member) and is fuse bonded adjacent the inner opening of the ink supply port and extends over a recessed geometric pattern 50 which is in the bottom wall of the cartridge. Alternately, the filter may be positioned inside a recessed pocket extending into the bottom wall of the housing adjacent the outlet port, and pattern 50 may be located in or extend into the recessed pocket. The geometric pattern forms a series of grooves 51 which extend along a longitudinal axis 52 from the outlet port and are used to transfer ink to the outlet port. The equi-spaced grooves are generally parallel to each other and have equal widths. The widths of each groove is equal to the space between grooves. A second set of grooves 53 is positioned along a transverse axis 54. The grooves are aligned on opposite sides of the outlet port and are parallel to each other. The grooves 53 are wider than grooves 51 and serve as drains or sinks to aid ink flow to the outlet port.

After the ink absorbing member has been installed and properly positioned in the first chamber, a cover 56 is fixedly secured to the housing, for example, by ultrasonic welding. The height of the ink absorbing member is slightly less than the inside height of the housing as measured between the bottom wall and the cover. Thus, there is no compression of the ink absorbing member in a vertical direction.

A silicone rubber seal member or grommet 74 is inserted into the chimney 46 adjacent the outlet port. The grommet is somewhat cup-shaped and has an open end facing toward the interior of the cartridge. A web of material is disposed closely adjacent the other, or outer, end which closes the grommet. The closed end of the grommet is pierced by a needle extending from an associated printer (not shown) to create an ink supply when and as the cartridge is mounted in a printer. A grommet retaining ring 76 placed onto the other end of the chimney over each grommet is ultrasonic ally welded into place. The grommet retaining ring has an enlarged central opening (not shown) to provide access to the grommet and the outlet opening. Also, the retaining ring includes slots 78 that align with and receive the terminal ends of extending ribs 79 on the chimneys.

The method of converting a single chamber into a dual chamber cartridge is as follows. First, the filter 48 is placed into the cavity of the housing over the outlet port, as indicated by item 120 in FIG. 5. The housing is inserted into a fixture with a vacuum source to pull a negative pressure through the outlet port. This holds the filter in position over the recessed geometric pattern 50 in the bottom wall of the cartridge. Then, the filter is secured to the housing, as indicated by item 122 in FIG. 5, such as by using a pneumatic cylinder to press a heated anvil onto the top surface of the filter causing the outer ends of the filter to fuse to the housing, for example.

The spacer 22 is then bent or folded along he score lines forming the spacer into a generally U-shaped conformation. T spacer is inserted into the housing, as indicated by item 124 in FIG. 5, with the all of the U-shaped spacer located toward the forward end of the housing and with the legs extending toward the rearward end in close proximity to opposed side walls of the housing. The notch in the U-shaped wall is located adjacent the bottom wall of the cavity. The spacer divides the internal cavity into first and second chambers 24, 26. The ink absorbing member 40 is then inserted into the first chamber over the filter screen and the ink outlet port, as indicated by item 126 in FIG. 5. After the porous member has been installed, the cover 56 is fixedly secured to the cartridge housing as indicate by item 128 in FIG. 5, such as by ultrasonic welding, for example.

The grommet 74 is mounted into the ink outlet port from the bottom and locked into position either thermally, i.e. ultrasonic ally or by other means, or by attaching the retaining ring 76 over the opening. The grommet is inserted with the open end facing the interior of the housing and the web or closed end facing the outside of the housing.

In the preferred embodiment, the cover has fill hole 80 and a recessed, vent passage 92, and is attached to the cartridge housing forming a fluid-tight seal therewith. Retained in the vent passage is a seal for selectively permitting the passage of fluid between the interior and the exterior of the cartridge. The seal is in the form of a check valve 100. However, it will be appreciated that the seal may take the form of any suitable sealing member, including a septum seal plug. The check valve 100 forms a one-way fluid passage between the interior and the exterior of the cartridge, permitting fluid to pass from the interior of the cartridge while preventing any substantial flow of fluid from the exterior to the interior of the cartridge.

The check valve 100 is inserted into the vent passage of the cover by positioning a stem of the valve into a recessed side of a key way slot of the vent passage formed in the cover. The stem is then pulled with a slow, steady force into a narrowed portion of the vent passage to assemble the valve to the cover. The valve acts as a one-way valve allowing air to pass out of and not re-enter the cartridge.

Figure 5:
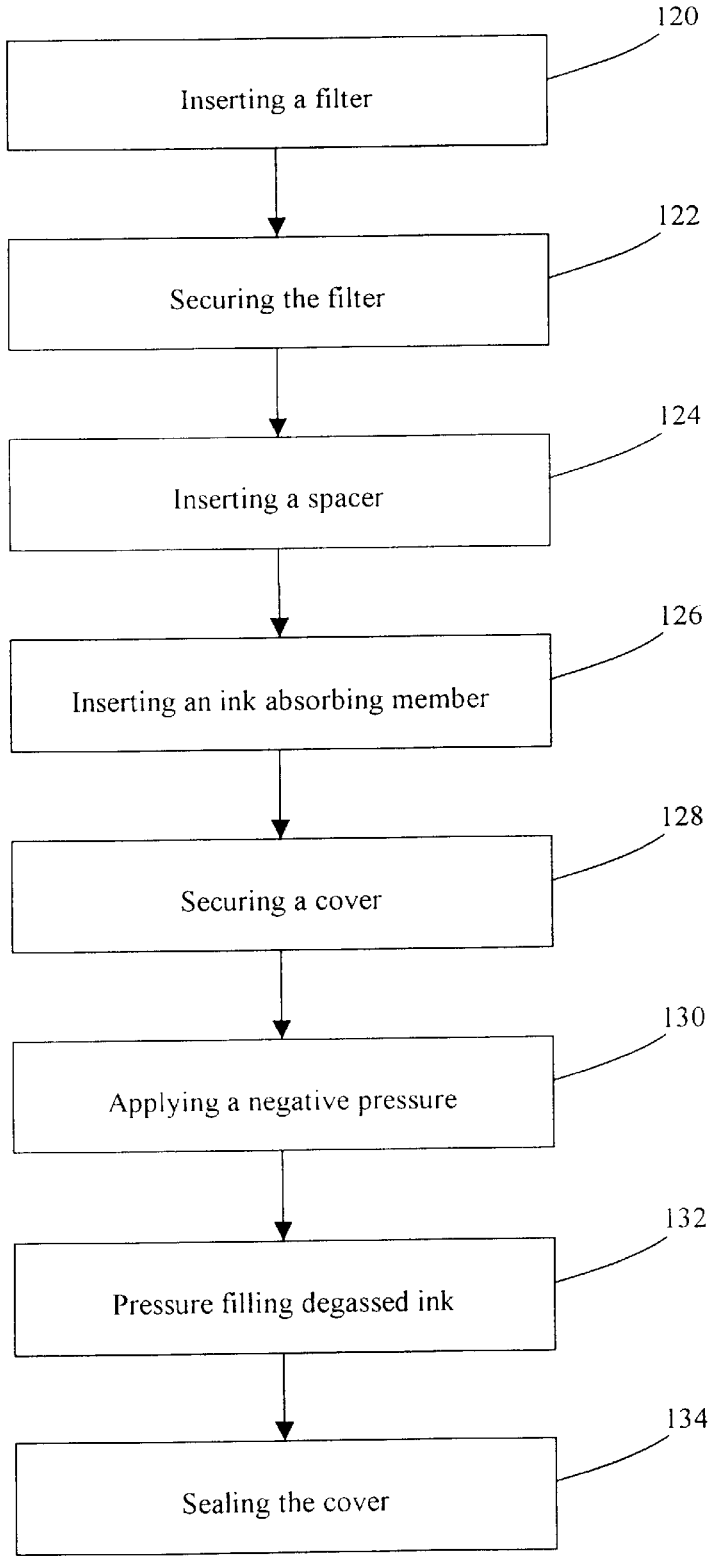
FIG. 5 is a flow chart showing steps of converting a dual chamber cartridge from a single chamber cartridge.

The assembled cartridge is inserted in a fixture and the region around the fill hole is sealed so that a negative pressure (a pre-fill vacuum of 27.5 in Hg within the cartridge) is applied to the cartridge through the fill hole to remove air from the open cells within the porous member, as indicated by item 130 in FIG. 5.

The cartridge is subsequently filled with ink through the fill hole of the cover using degassed ink, as indicated by item 132 of FIG. 5. Either black ink or different color inks, i.e. cyan, magenta, and yellow ink, may be introduced into the chamber(s) of the cartridge. The ink is introduced under pressure into the cartridge to maximize the amount of ink for consumer end use and minimize the likelihood of air bubble entrapment.

After the cartridge has been evacuated and pressure filled, the cartridge is again evacuated through the filling port to degas the ink which may have retained air during the filling operation. The filling port is then sealed, such as by seal film 90, and a negative pressure is applied to the cartridge through the check valve which opens in response to the negative pressure causing the generation of a negative pressure within the cartridge. Once the vacuum pressure is discontinued, the one-way check valve closes retaining the negative pressure within the cartridge. Subsequently, the remainder of the cartridge cover is sealed with a laminate seal thermally attached to the remaining portion of the cover over the diaphragm valve, indicated by item 134 in FIG. 5, to seal air from the cartridge until the seal is removed by the consumer when the cartridge is installed on the printer. It will be appreciated that the fill hole is utilized as a vent hole after the foil seal is removed by the consumer.

Prior to shipment, each cartridge is shrink wrapped with an air permeable cellophane type material. By shrink wrapping the cellophane over the cartridge, any potential leakage of ink from the cartridge into a packaging bag is limited.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

Having thus described the invention, is claimed:

1. A method of converting a single chamber ink-jet cartridge into a two chamber cartridge comprising the steps of:

inserting a removable spacer into a cavity in a housing to divide said housing into first and second chambers;

inserting an ink absorbing member into one of said first and second chambers;

sealing an ink outlet port of said housing for preventing air from entering said cartridge;

filling said cartridge with ink;

sealing the fill hole; and, sealing said cartridge.

2. The method of claim 1 further comprising the step of:

inserting a filter into a bottom wall of the housing above an ink outlet port opening.

3. The method of claim 2 further comprising the step of:

fusing said filter to secure edges of said filter into said bottom wall.

4. A method of claim 2 further wherein the ink outlet port sealing step includes the step of inserting a seal member in the ink outlet port.

5. The method of claim 1 further comprising the step of:

fusing a cover to a top portion of said housing.

6. The method of claim 5 further comprising the step of:

pressure filling degassed ink through said fill hole in said cover.

7. A method of converting a single chamber ink-jet cartridge into a two chamber cartridge comprising the steps of:

bending a removable spacer to form a generally U-shaped conformation;

inserting said removable spacer into a cavity a housing to divide said housing into first and second chamber;

inserting an ink absorbing member into one of said first and second chambers;

sealing an ink outlet port of said housing for preventing air from entering said cartridge;

filling said cartridge with ink;

sealing the fill hole; and, sealing said cartridge.

8. The method of claim 7 further comprising the step of:

inserting said spacer into said housing with a wall of said spacer toward a forward end of said housing, and with legs of said spacer extending toward a rearward end of said housing in close proximity to side walls of said housing.

9. The method of claim 8, further comprising the step of:

positioning a notch in said spacer to face toward said bottom wall of said housing.

10. The method of claim 1, further comprising the step of:

applying a negative pressure to said cartridge to substantially remove air from said cartridge prior to filling said cartridge with ink.

11. An ink tank cartridge for an associated ink-jet type recording apparatus, the ink tank cartridge comprising:

a housing having a plurality of walls forming cavity and a bottom wall;

a removable divider wall in said cavity dividing said cavity into a first chamber and a second chamber;

a porous member in one of said first and second chambers, said porous member abutting said bottom wall; and, said divider wall having an opening to allow ink to pass from one of said chambers to the other of said chambers.

12. An ink tank cartridge for an associated ink-jet type recording apparatus the ink tank cartridge comprising:

a housing having a plurality of walls forming a cavity and a bottom wall;

a removable divider wall in said cavity dividing said cavity into a first chamber and a second chamber, said divider wall having a wall section and a pair of legs extending from said wall section, said legs being spaced apart and approximately parallel to each other;

a porous member in one of said first and second chambers, said porous member abutting said bottom wall; and, said divider wall having an opening to allow ink to pass from one of said chambers to the other of said chambers.

13. The ink tank cartridge of claim 12, wherein said divider wall is substantially U-shaped, said U-shaped divider wall being formed by said legs and said wall section.

14. The ink tank cartridge of claim 13, wherein said wall section includes an opening adjacent a bottom edge of said wall section.

15. The ink tank cartridge of claim 14, wherein said divider wall opening is adjacent said bottom wall of said housing.

16. The ink tank cartridge of claim 15, wherein said wall section of said divider wall is positioned toward a forward end of said housing, and said legs extend toward a rearward end of said housing in close proximity to side walls of said housing.

17. The ink tank cartridge of claim 11, further comprising a groove in said bottom wall for transferring ink from said porous member to said ink outlet port.

18. The ink tank cartridge of claim 11, further comprising a filter positioned over said ink supply port and said groove.

19. An ink tank cartridge for an associated ink-jet type recording apparatus the ink tank cartridge comprising:

a housing having a plurality of walls forming a cavity and a bottom wall;

a removable divider wall in said cavity dividing said cavity into a first chamber and a second chamber said divider wall comprises first wall section, a second wall section, and a third wall section, and said first and second wall sections are hingedly connected to said third wall section;

a porous member in one of said first and second chambers, said porous member abutting said bottom wall; and, said divider wall having an opening to allow ink to pass from one of said chambers to the other of said chambers.

20. A divider wall for an ink tank cartridge for converting the ink tank cartridge from a single chamber cartridge to a dual chamber cartridge, said divider wall comprising:

a wall section and a pair of legs extending from said wall section in a substantially U-shape; and, said wall section having an opening formed adjacent a bottom edge of said wall section and disposed adjacent a bottom wall of said cartridge.

* * * * *